US005356496A

United States Patent [19]

Lincoln et al.

[11] Patent Number: 5,356,496

[45] Date of Patent: Oct. 18, 1994

[54] SPLICE TAIL TAPE-DOWN METHOD AND APPARATUS

[75] Inventors: Edward M. Lincoln, Liverpool, N.Y.; William J. Winch, III, E. Brunswick, N.J.

[73] Assignee: The Black Clawson Company, Middletown, Ohio

[21] Appl. No.: 898,423

[22] Filed: Jun. 15, 1992

[51] Int. Cl.[5] ..... B65H 19/18; B65H 19/20

[52] U.S. Cl. ..... 156/64; 156/159; 156/361; 156/504; 156/505

[58] Field of Search ..... 156/159, 361, 64, 504, 156/505, 157

[56] References Cited

U.S. PATENT DOCUMENTS

| | | | |
|---|---|---|---|
| 3,024,157 | 3/1962 | Beerli . | |
| 3,243,337 | 3/1966 | Haselow et al. | 156/504 X |
| 3,253,795 | 5/1966 | Penrod et al. . | |
| 3,514,363 | 5/1970 | Stone et al. . | |
| 3,567,534 | 3/1971 | Kushiro | 156/64 |
| 3,654,035 | 4/1972 | Takimoto | 156/505 |
| 4,238,261 | 12/1980 | Tetro . | |
| 4,581,083 | 4/1986 | Schutz et al. | 156/64 |
| 4,878,982 | 11/1989 | Ogata et al. . | |
| 4,967,974 | 11/1990 | Kawamura . | |
| 5,045,134 | 9/1991 | Schenker et al. | 156/64 |

OTHER PUBLICATIONS

Paper, Film & Foil Converter, Continuous Splicing Techniques, Nov. 1987, R. Duan Smith.

*Primary Examiner*—Mark Osele

*Attorney, Agent, or Firm*—Biebel & French

[57] ABSTRACT

In the field of unwinding webs from an unwind stand in which a fresh web is prepared with a paste strip and is lapped spliced to a progressing expiring web, and the expiring web is then cut upstream of the splice to form a tail, the position of the tail is predicted or detected, and the movement thereof to a taping station causes a tape support roll, which supports a strip of one-sided adhesive tape to be applied to the tail in such a manner that part of the adhesive strip covers the tail and part of the strip engages the underlying web so that the tail becomes firmly taped down to the web thereby permitting the web to be run in either direction through processes such as converting processes, coating processes or the like. Embodiments of tape tail detectors are disclosed and embodiments of hold-down tape transfer mechanisms are disclosed.

13 Claims, 12 Drawing Sheets

53
54
50
52
25
80
34
20
81
11

53
54
50
52
80
82
20
25a
11

53
54
50
52
82
81
80
34
11

SPLICE TAIL TAPE-DOWN METHOD AND APPARATUS

BACKGROUND OF THE INVENTION

This invention relates to the art of dispensing moving webs of paper, plastic and the like, in which the leading end of a fresh roll of web material has been spliced onto an expiring roll of such web material, and a portion of the web issuing from the expiring roll has been severed from the remaining portion of the roll.

Automatic web splicing apparatus for web unwind systems is known for forming butt splices or overlapping splices. The most common splicing apparatus forms an overlapping splice. The web from the expiring roll, following the splice, is severed so that a short tail of material, formerly part of the expiring web, follows the splice as it progresses through subsequent coating and/or converting stages.

The actual length of the tail, following cutting from the expiring roll, will vary in accordance with the reaction time of the knife, web speed, the particular equipment being used, and in the case of manual or semiautomatic operation, the skill of the operator. Thus, in certain manual or semi-automatic splice control systems, a two foot tail at 500 feet per minute could become a four foot tail at 1,000 feet per minute web speed.

Modern unwind systems may be programmed to take into account variables which affect tail length, so that the expiring web can always be cut at about the same length following the splice over a wide range of variables which include line speed and unwind roll diameters. For example, one such system, in combination with a turret-type winder, is described in Penrod et al, 3,253,795 issued May 31, 1966, and computer controlled versions of this system are sold by the assignee of this application, The Black Clawson Company, under the trade name "AccuTail."

While such systems are capable of stabilizing the length of the free tail, it is not usually practical in such systems to provide an overlap splice which has no tail. Even a short loose tail portion can flap around as the web is curved around rolls, and can interfere with the proper movement of the splice through downstream machinery. An unsecured trailing edge or tail can disrupt downstream processes, such as coating processes. Further, in cases where the web is rewound it may not be directly used by other processes, and an unsecured tail in a subsequent process may lead rather than follow, thereby disrupting the process or even tearing or breaking the web.

In systems which form overlapping splices, there is a need for an apparatus and method by which a free tail extending from the splice may be controlled by attaching or affixing the tail to the progressing web so that it cannot interfere with subsequent handling of the web.

SUMMARY OF THE INVENTION

The above described problems of a loose tail following a lap splice are solved by this invention, in which the position of the tail end is sensed and the tail is taped down to the surface of the progressing new web at a taping station downstream from the splice. This is accomplished in the preferred embodiment by the placing of a marker or signal device to indicate the position of the cut end of the tail, providing means for detecting the marker or signal, and applying to the tail and the web a transverse tape to hold the tail against the web.

The indicator means may consist of a strip of retro-reflective marker tape or the like which is applied somewhat spaced from the leading edge of the fresh web, and spaced from the actual region of the splice, so that at least a portion of the marker tape will extend beyond the end of the tail. Such portion accurately indicates the position of the cut end of the tail on the web. Alternatively, other indicator means may be used, such as a marker applied to the expiring web, by the knife or cutting apparatus, or a signal representing knife actuation or web/knife contact.

The prepared adhesive tape is retained on an applicator which may be a suction or vacuum roll. Control means which senses the presence or position of the indicator or marker also positions the tape and applicator roll in such a manner that the tape is transferred to the progressing web in an accurately timed manner, so that a portion of the tape overlaps the tail and a further portion of the tape overlaps the web.

The apparatus and method of the present invention operates to tape down the trailing tail or edge of a cut progressing web to the exposed surface of the fresh web after the fresh web has been spliced, without interrupting the motion of the progressing web. A smooth transition is formed which is acceptable to many processes. Also, after the web is wound, it may then be paid out directly into other processes since the taped down tail is now usually acceptable as a leading edge.

As mentioned, a vacuum or suction roll holds the prepared tape prior to taping. The position of the suction roll and tape are controlled by a signal which is responsive to the position of the tail, so that the tape is applied in such a manner that it coincides with the trailing cut edge of the tail.

The detection system is keyed on the cut end of the tail and is independent of tail length, which can vary from splice to splice and from system to system. When a very short tail is taped down, the tape may actually cover all or part of the splice. However, a long tail may also be accurately located and taped down without disturbing the travel of the progressing web.

It is accordingly an important object of this invention to provide an apparatus and method by which the trailing tail from a splice may be taped down onto the moving web.

A further object of the invention is the provision of apparatus and means for predicting or detecting the position of a splice tail, for the application of a strip of tape thereto.

A further object of the invention is the provision of a tail tape-down arrangement and method employing a vacuum or suction roll for supporting a prepared piece of tape, together with means for relatively moving the roll and the web at the precise time that the tail passes the tape.

These and other objects and advantages of the invention will be apparent from the following description, the accompanying drawings and the appended claims.

BRIEF DESCRIPTION OF THE ACCOMPANYING DRAWINGS

FIG. 1 diagrammatically shows an overall web path together from an unwind in a first embodiment of the invention;

Figure 1:
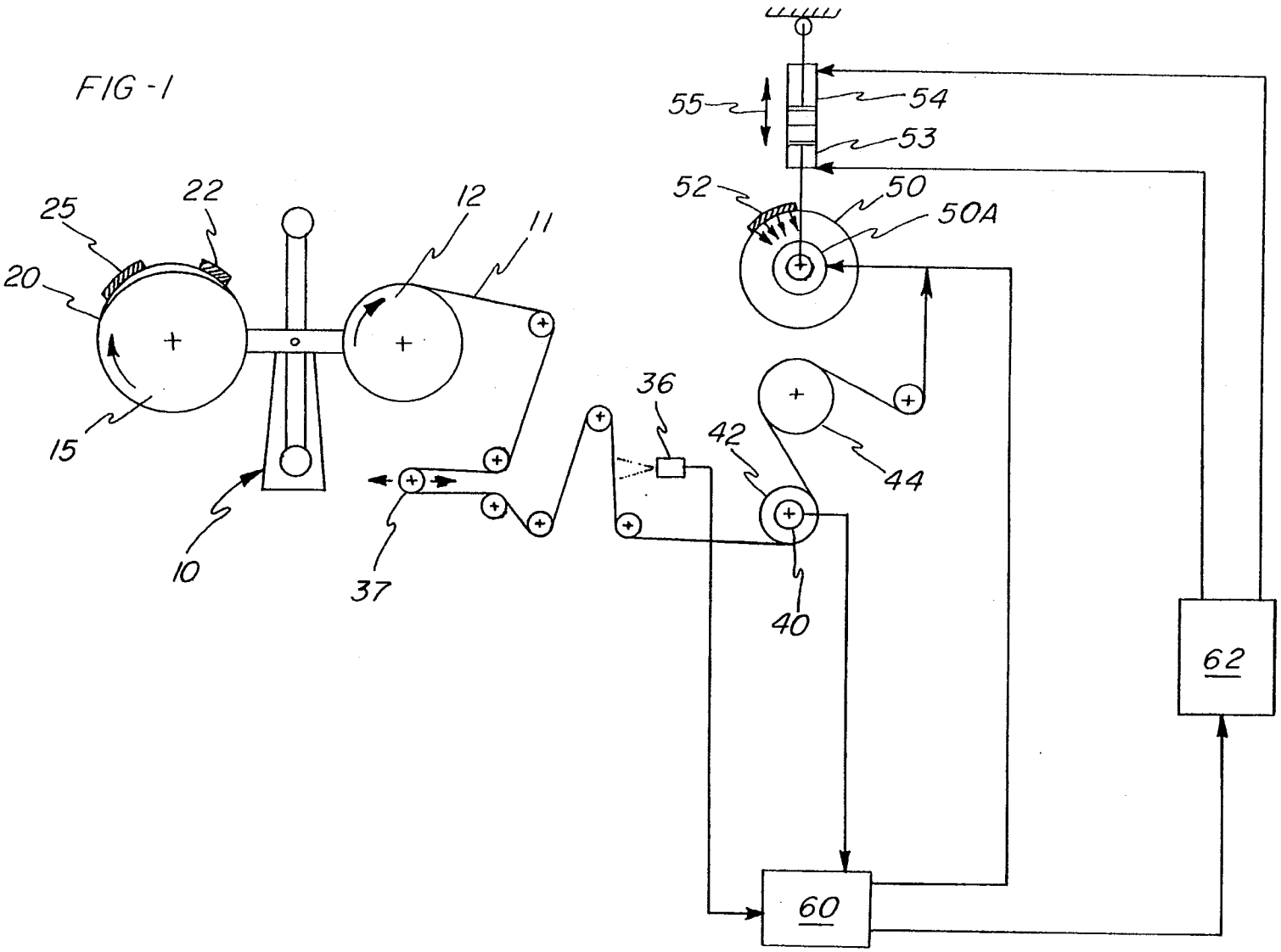
Figure 7:
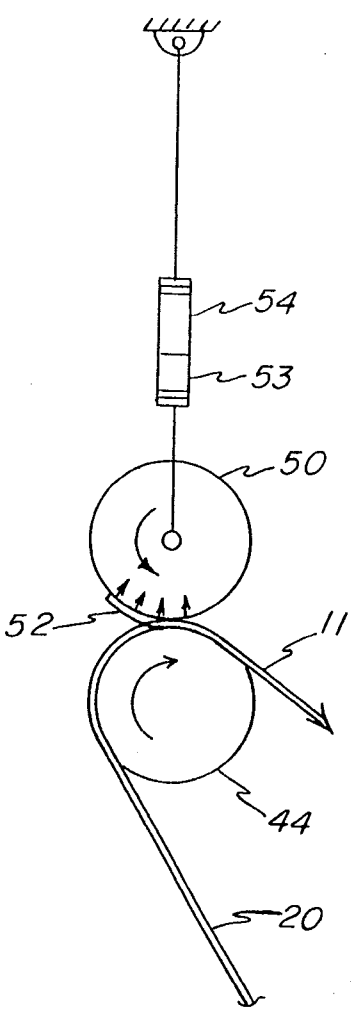
Figure 8:
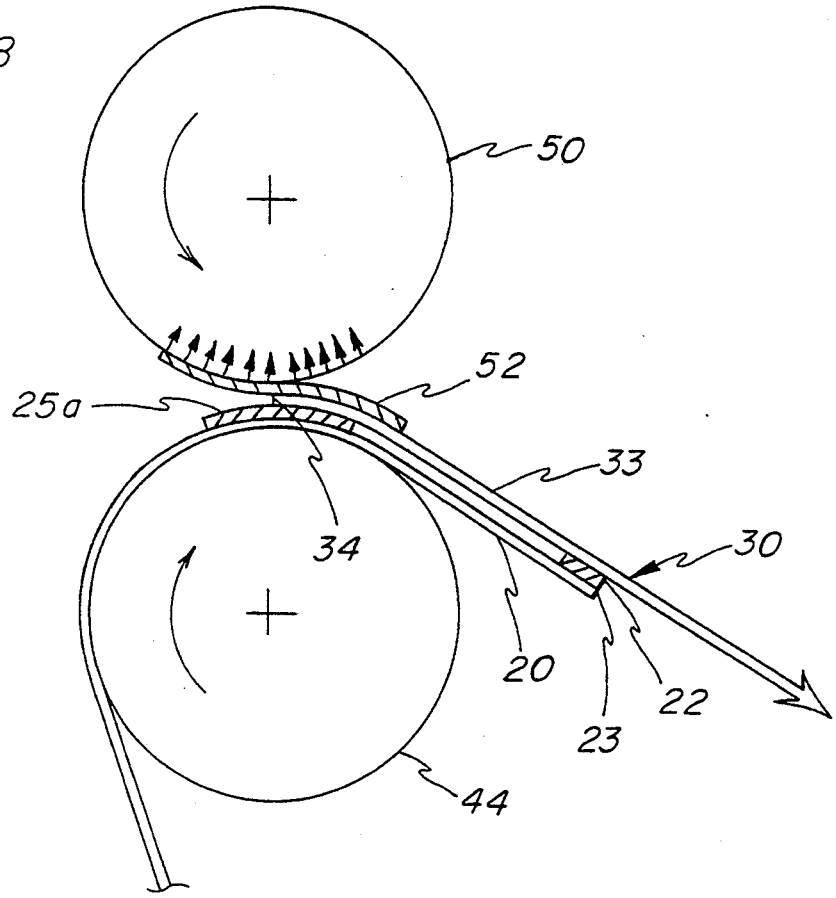
Figure 9:
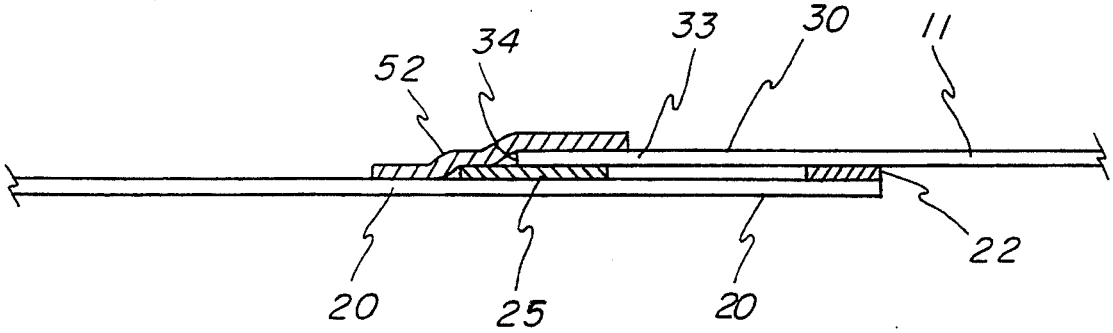
Figures 10, 11, 12:
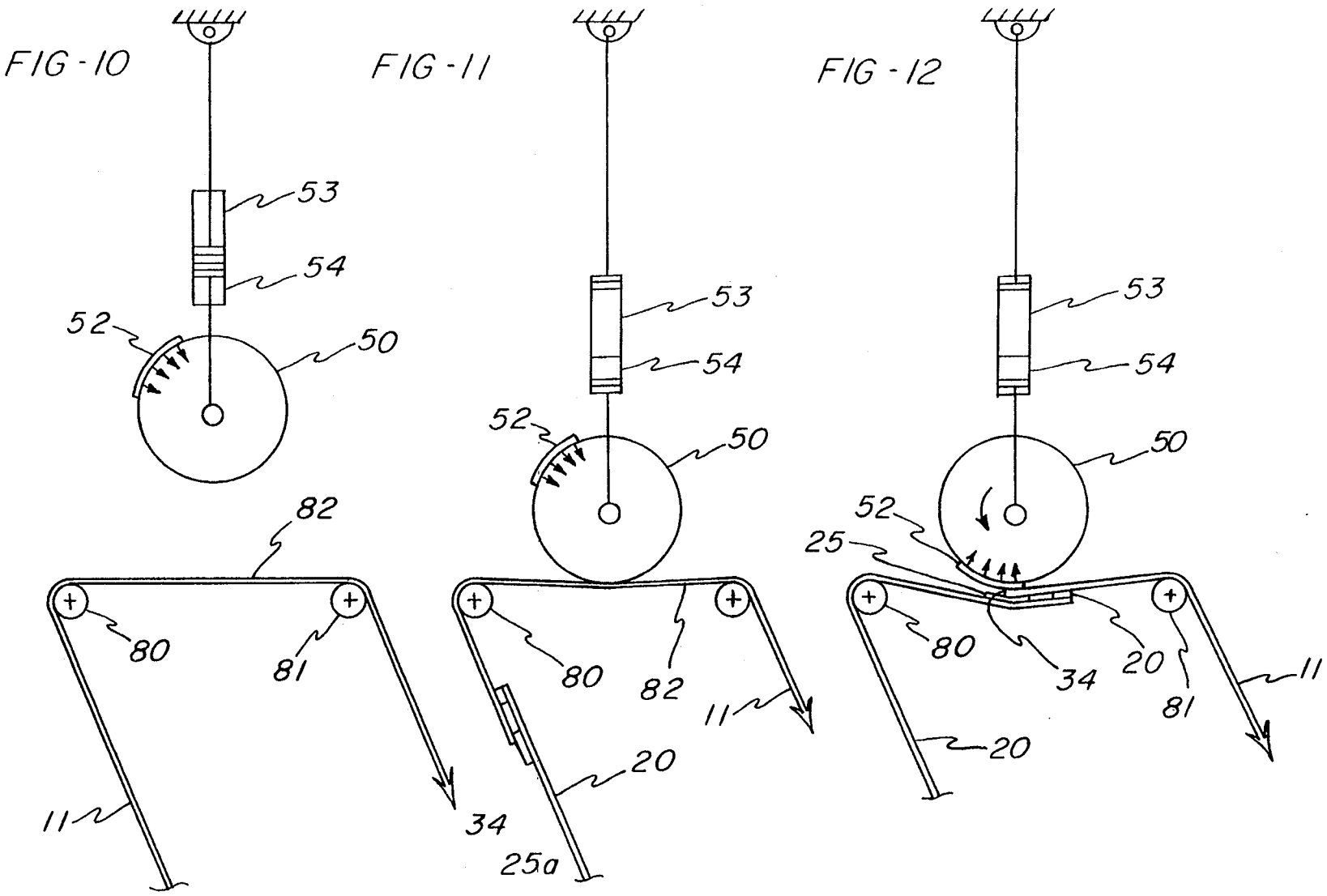
Figure 13:
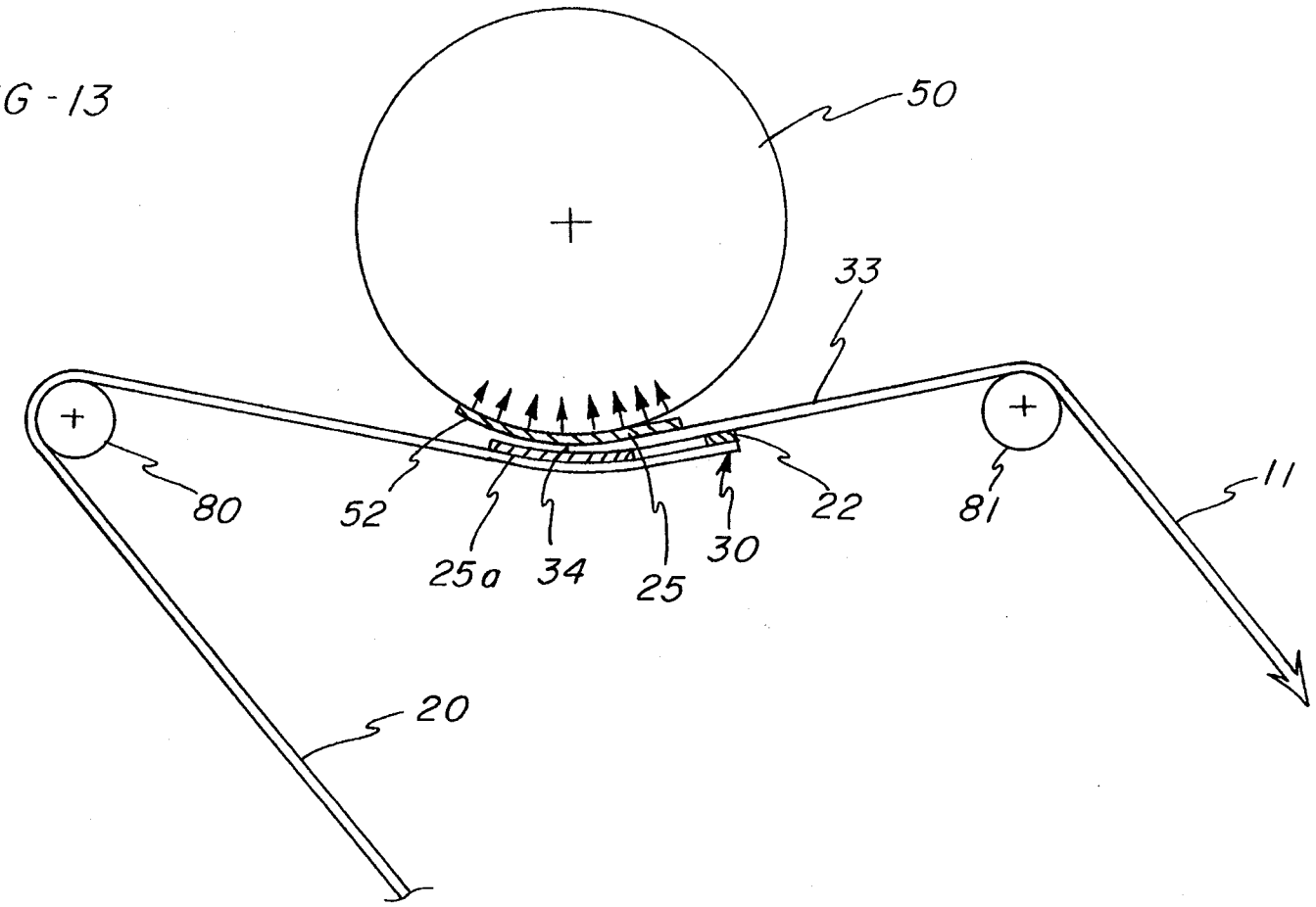
Figure 14:
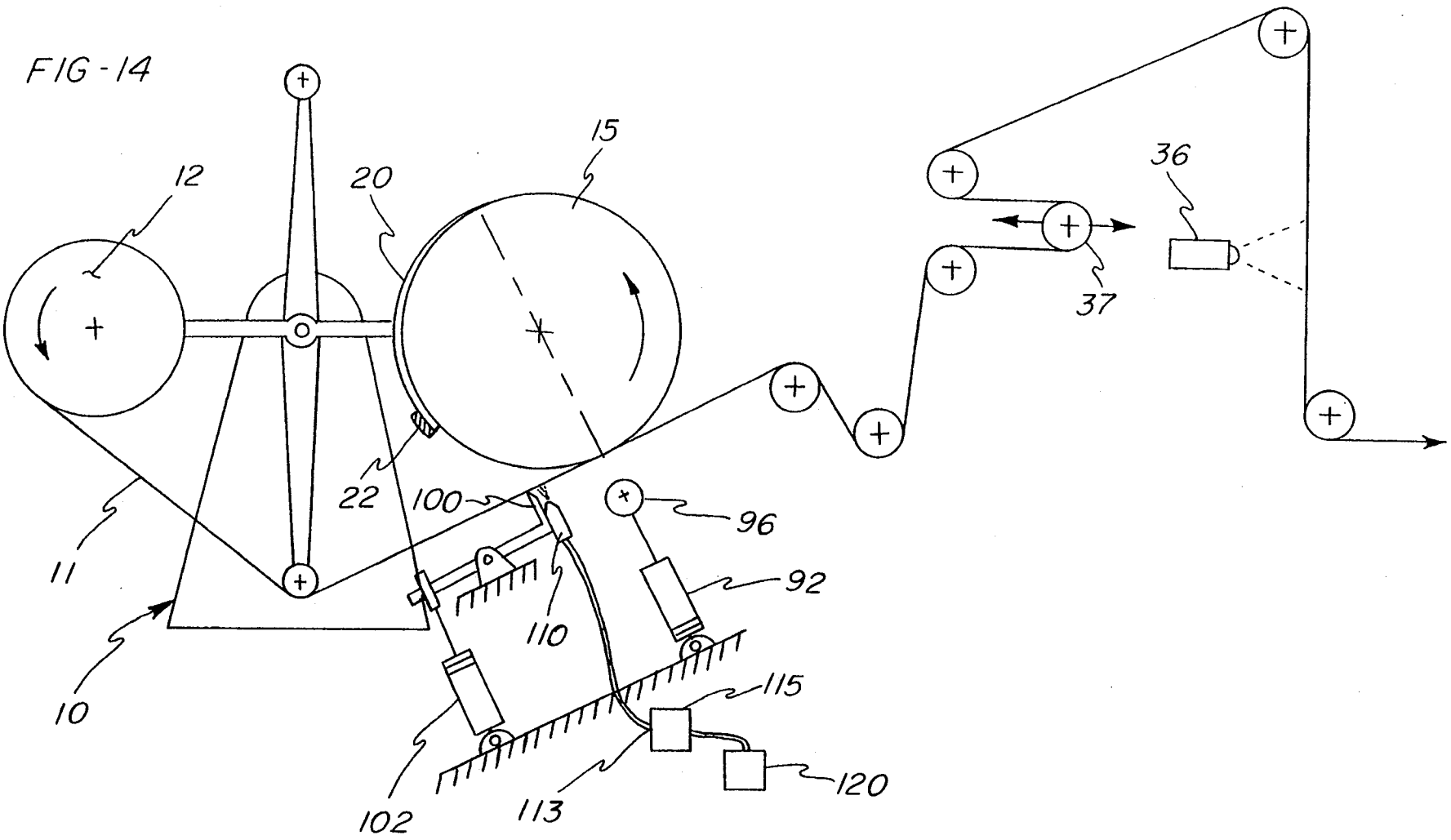
Figure 15:
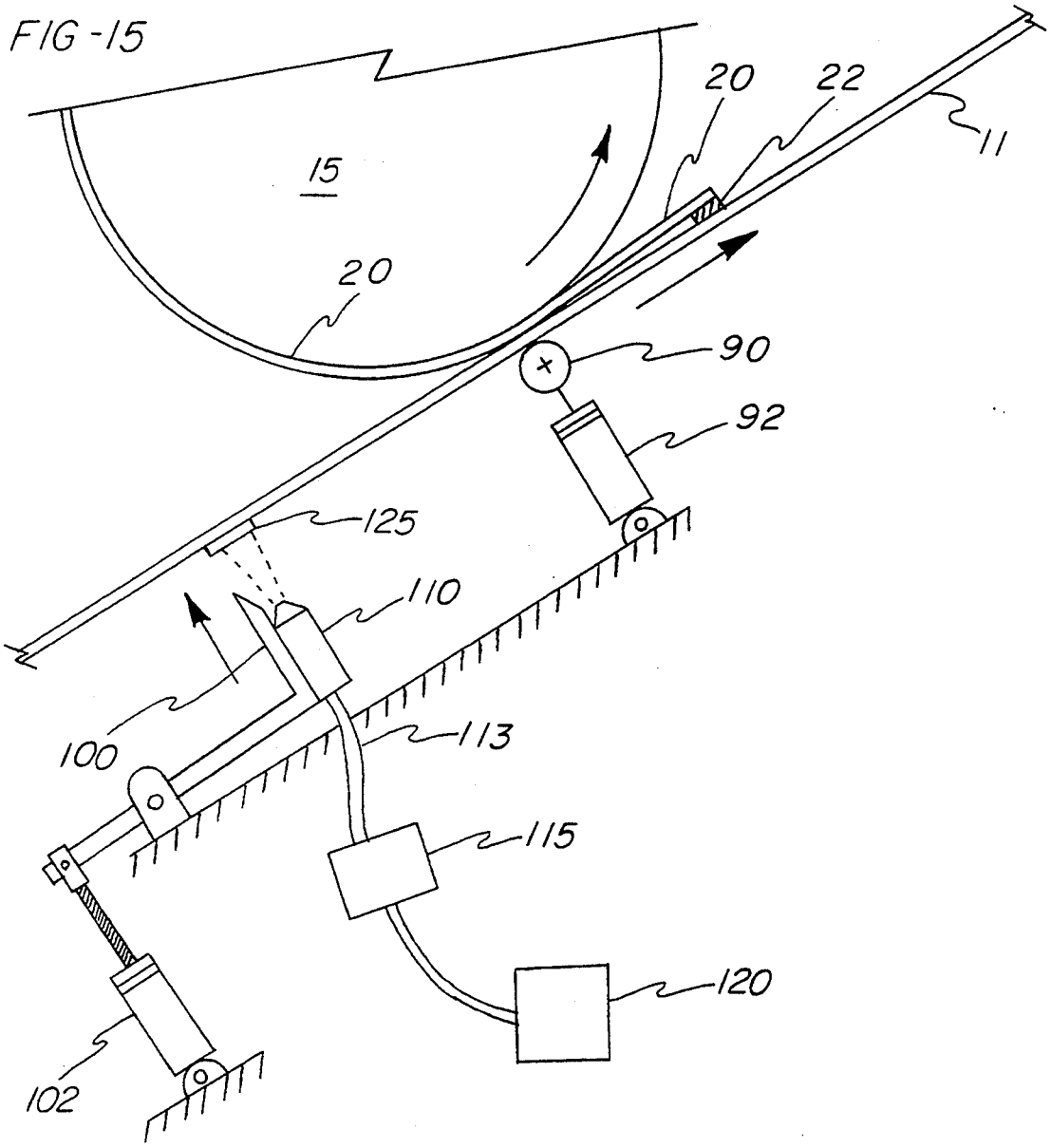
Figure 16:
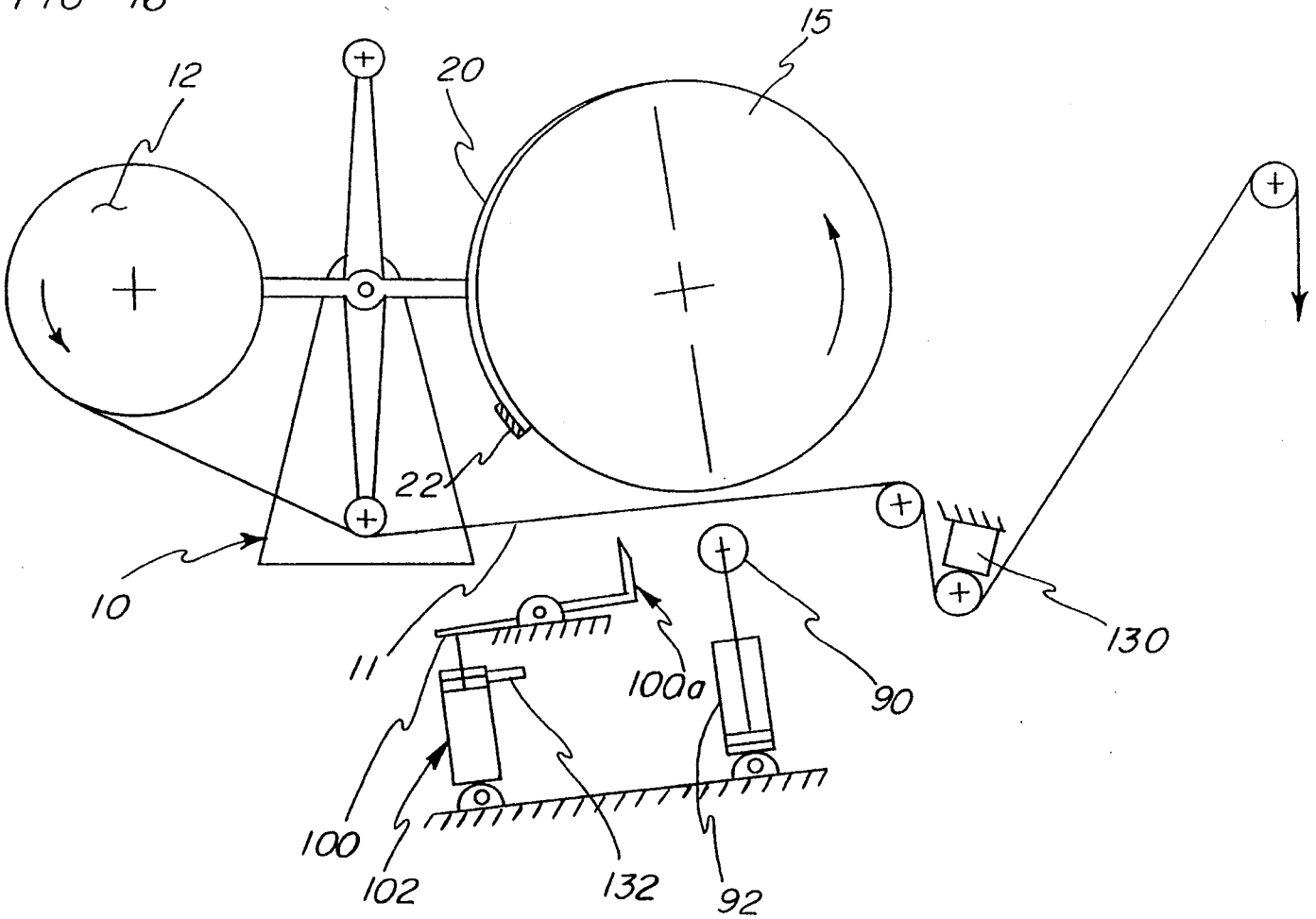
Figure 17:
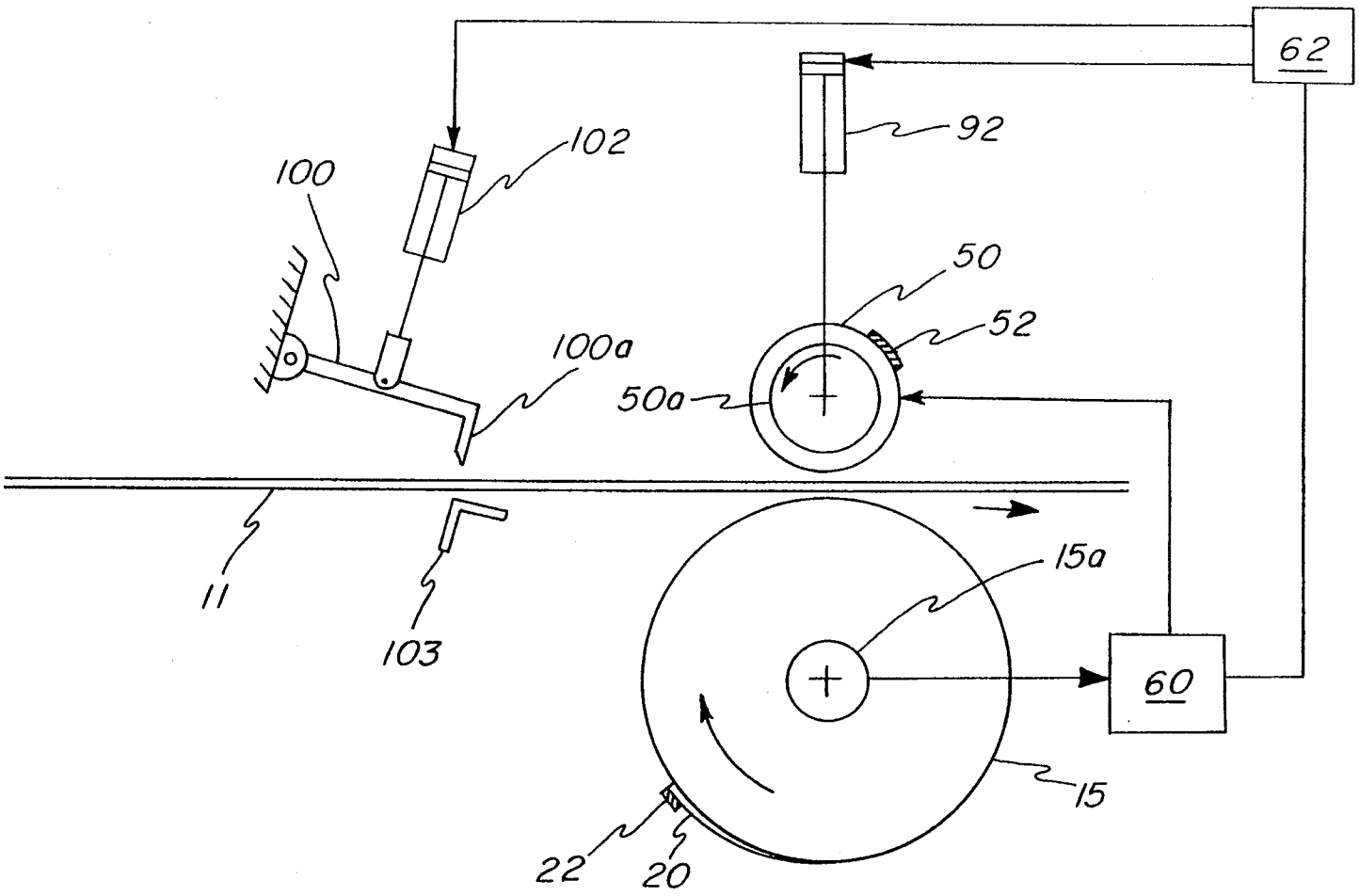
Figure 18:
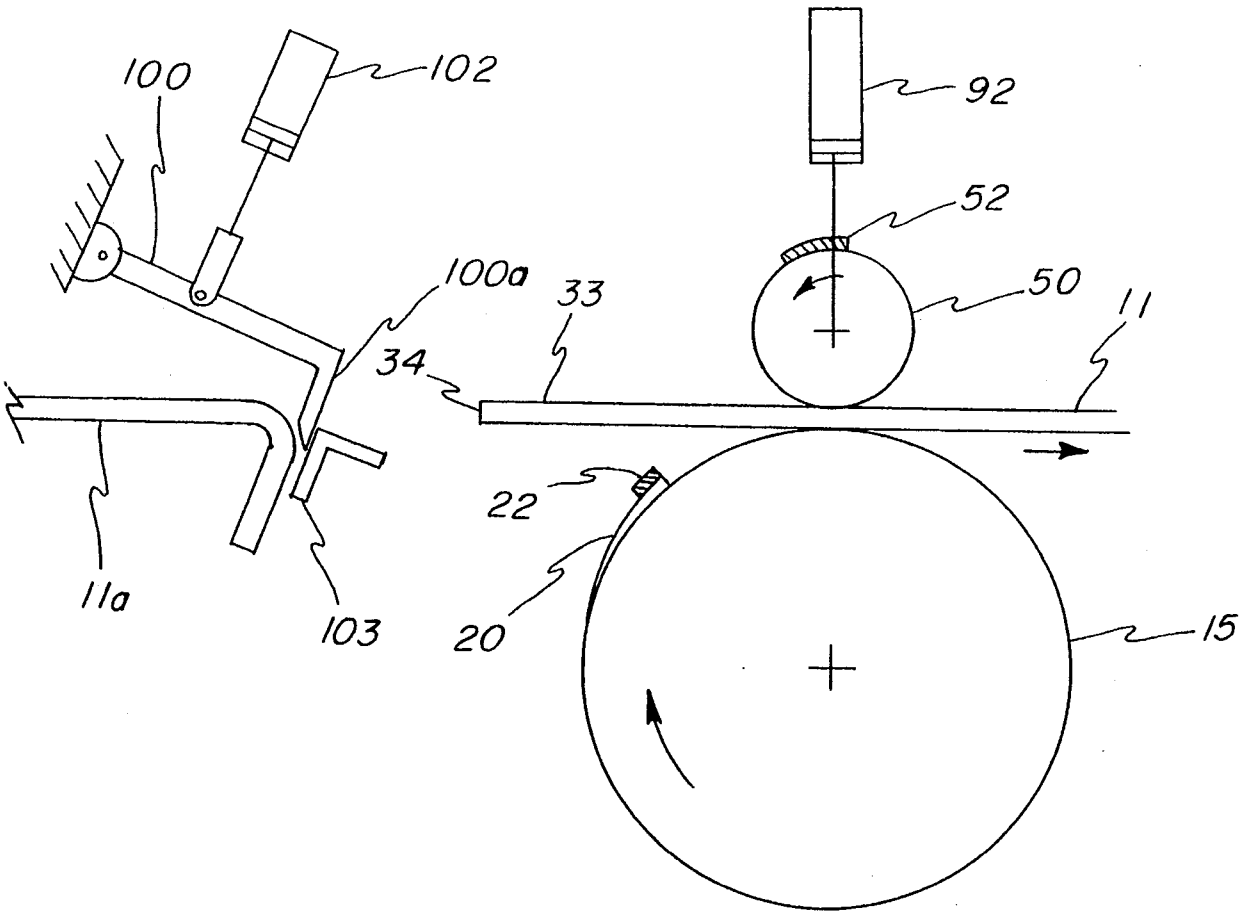
Figure 19:
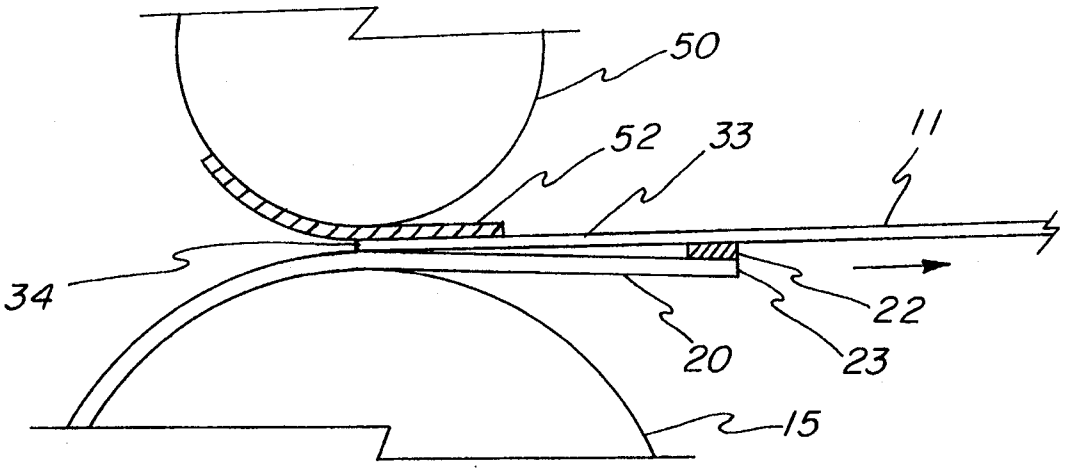

FIGS. 4, 5, 6 and 7, respectively, show progressing positions of the tape timing and deposition system of a first embodiment of the invention;

FIG. 8 is an enlarged view, similar to FIG. 7, showing the details of the release of the tape onto the tail;

FIG. 9 is a sectional view illustrating the final result of a tail taped down against the outer surface of the fresh web;

FIGS. 10, 11 and 12 show respective progressing positions of an alternative deposition system;

FIG. 13 is an enlarged view of FIG. 12 showing details of the alternative deposition of the tape onto the web;

FIG. 14 is a diagram, similar to FIG. 1, but showing a modification of the invention in which a marker, at the cut end of the tail, is applied by the knife mechanism;

FIG. 15 is an enlarged fragment of a portion of FIG. 14 showing the signal or marker applicator arrangement;

FIG. 16 is a further diagram of an embodiment of the invention in which the tail position is determined by a signal coincidental with knife actuation;

FIG. 17 is a diagram of a further embodiment of the invention in which the function of the tape support roll is combined with that of the splicer or paster roll;

FIG. 18 shows a progressed position from FIG. 17 in which the tail has been created by the actuation of the cut-off knife; and FIG. 19 is a sectional view illustrating the deposition of the tape as it and the tail pass through the nip of the tape support role and the fresh roll.

DESCRIPTION OF PREFERRED EMBODIMENTS

Referring to FIG. 1, which illustrates one preferred embodiment of the invention, a turret-type web unwind stand is illustrated generally at 10. While a turret type unwind stand is illustrated, it is understood that any kind of an unwind may be used which will pay off a progressing web 11 from an expiring roll 12, and which will support one or more fresh rolls 15. The unwind stand or its associated equipment conventionally includes splicing apparatus by means of which the web from the fresh roll 15 is spliced onto the progressing web 11 from the expiring roll 12 without interrupting the movement of the web. It is further understood that a lapped splice will be formed, and following the splice, the web leading back or upstream to the expiring roll 12 will be cut by a knife or the like, thereby leaving a tail of some finite length behind the splice.

The unwind, splicing assembly and cut-off knife may be of the kind described in the previously identified U.S. Pat. No. 3,253,795. However, additional examples of turret type unwinds, web splicing apparatus, and cut-off knives are shown in Anderson, U.S. Pat. No. 3,309,036 issued Mar. 14, 1967 and Phelps et al, U.S. Pat. No. 3,831,876 issued Aug. 27, 1974. The systems disclosed in the latter two patents are of interest in that they can splice selectively on either side of an unwinding web, and show corresponding knife arrangements by which the web leading to the expiring roll may be cut off, whether the process line downstream calls for over-splicing, that is, the inside of the web uppermost, or calls for under-splicing, in which the outside of the web is uppermost.

Figure 2:
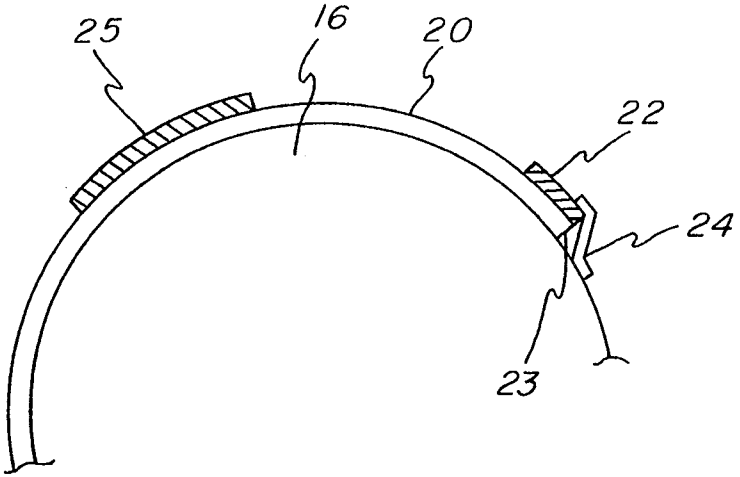
FIG. 2 is an enlarged fragmentary sectional view showing the details of a prepared leading edge on a fresh roll ready to be spliced to the progressing web.

FIGS. 1 and 2 also illustrates the preparation of the fresh roll in accordance with one embodiment of the invention. Referring to the enlarged fragmentary detail of FIG. 2, the outer turn or layer of the web 20 on the fresh roll 15 is prepared with a two-sided splicing tape 22 positioned immediately along a freshly prepared and cut forward edge 23 of the web 20. Also, a plurality of transversely positioned frangible hold down or tear tabs 24 hold the outer web layer against the roll 15 during the speed-up of the fresh roll 15 and prior to splicing. In addition, in accordance with one embodiment of the invention, a marker strip or length 25 of retro-reflective tape is positioned along the first or outer turn of the fresh roll 15.

The peripheral position of the tape strip 25 is determined to be in the general position of the tail expected so that at least a portion of the strip 25 will extend from beneath the tail, thereby forming an optically detectable marker means for indicating the position of the tail. Thus, the peripheral positioning of the marker strip 25 requires some understanding as to the length of tail which will be formed by the splicer. Also, the tape strip is positioned transversely such that it is lined up with the detection system.

Figure 3:
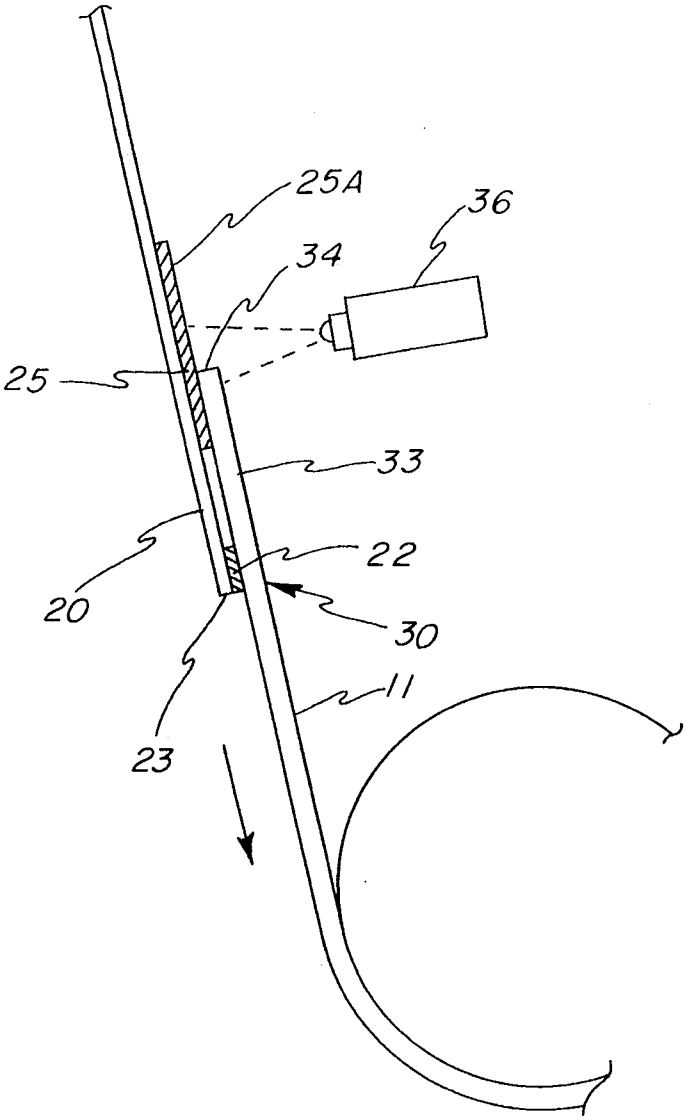
FIG. 3 illustrates the indicator tape and the splice detection system after the splice has been made.

The leading edge 23 is spliced to the progressing web 11 and a cut-off knife (not shown) cuts the expiring web to form a tail in the conventional manner. The condition which follows the splice is illustrated in enlarged detail in FIG. 3. The splice, accomplished by the splicing tape 22, is illustrated generally by the reference numeral 30 and is characterized by a rearwardly extending tail 33. The tail 33 overlaps the web 20 and extends at least partially over the longitudinally-extending indicator strip 25. An exposed portion **25*a* of the strip 25 extends rearwardly of the cut end 34 of the tail 33, thereby forming a marker or indicator means which identifies the position of the tail cut end 34**.

Since the length of the tail 33 is generally known, for any particular set-up, the strip 25 of marker tape is positioned and prepared on the fresh web 15 to coincide generally to the terminal end 34 of the expected tail, simply by measuring circumferentially from the splicing tape 22. For example, if the tail is known to be around 8 inches in length, a strip 25 of reflective tape may be about 6–10 inches in length so that its forward or leading edge is substantially less than 8 inches from the tape 22 and its trailing end is substantially more than 8 inches, assuring that a portion **25*a* will, in all conditions, extend out from under the cut end 34 of the tail 33** to form and define the indicator marker or indicating device employed by this embodiment such that its position can be detected.

A photocell 36 (FIG. 1) may form the means by which the marker portion **25*a* is detected downstream from the splicing apparatus. It will be understood that the detector means, such as the photocell 36, is located at a position along the length of the progressing web which has a non-varying relation to the downstream tail taping apparatus. Therefore, it is preferred to route the web 11 from the unwind 10 over a series of supply control rolls which include a dancer roll 37. In this manner, a constant tension may be applied to the web upstream of the detector 36. However, the dancer roll 37 must be upstream of the photocell 36**.

FIG. 1 illustrates a typical position for the photocell 36 and also shows a web path which includes a web speed sensor 40 and the speed sensor's roll 42. The speed sensor provides the means by which the movement of the splice 30 and tail 33 may be accurately timed.

The web 11 is carried over a rubber covered backing roll 44, for co-action with a tape support roll 50 in the form of a motor driven suction or vacuum roll. The roll 50 has a transversely elongated strip of one-sided adhesive tail hold-down tape 52 positioned on its surface. The roll's position is controlled by a pair of positioning devices such as the pair of hydraulic cylinder motors 53 and 54, to move either toward or away from the backing roll 44, as represented by the arrows 55. The transverse length of the tail hold-down tape 52, as supported on the surface of the roll 50, corresponds substantially to the full width of the progressing web 11.

It will be understood that the tape support roll 50 in this embodiment is a vacuum roll of conventional design with a foraminous mantel or perforated outer shell through which air is drawn, thereby retaining the tape strip 52 in a predetermined and selected position on the outer surface of the roll 50, for release. An acceptable alternative is to retain the tape strip to the tape support roll 50 by a means other than vacuum. For example, a plurality of transversely positioned frangible hold down or tear tabs, or a static charge may be used.

The signal output from the photocell 36, and the web speed output from the web speed sensor 40, is supplied to a central processing unit or controller 60. The controller 60 applies the necessary control signal to the motor 50A of the roll 50 and to a hydraulic control unit 62 which supplies hydraulic fluid to the cylinder motors 53 and 54, in accordance with bulk speed and tail location.

Figure 4:
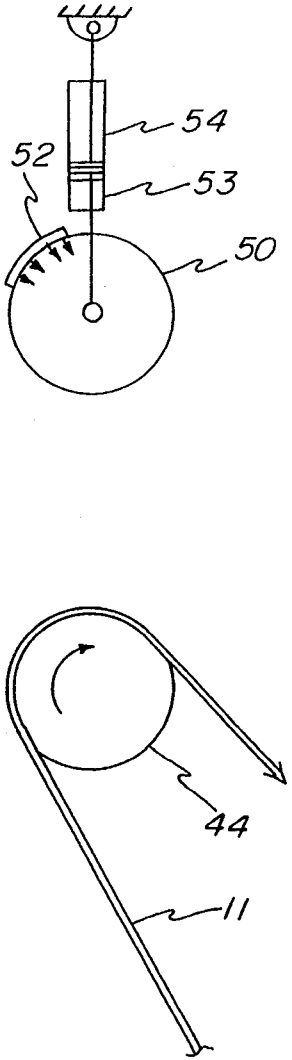

The progressive views of FIGS. 4 through 7 illustrate the means by which the roll 50 is brought into taping position with the progressing web 11, the position of which is timed in such a manner that the strip of tape 52 is picked off of the vacuum roll 50 and applied over the end 34 of the tail 33. Thus, FIG. 4 shows the vacuum roll 52 just prior to being accelerated by the motor 50A. The wide strip of single sided adhesive tape 52 has previously been properly positioned over the vacuum holes, with the adhesive side facing outwardly, as shown in FIG. 4.

Figure 5:
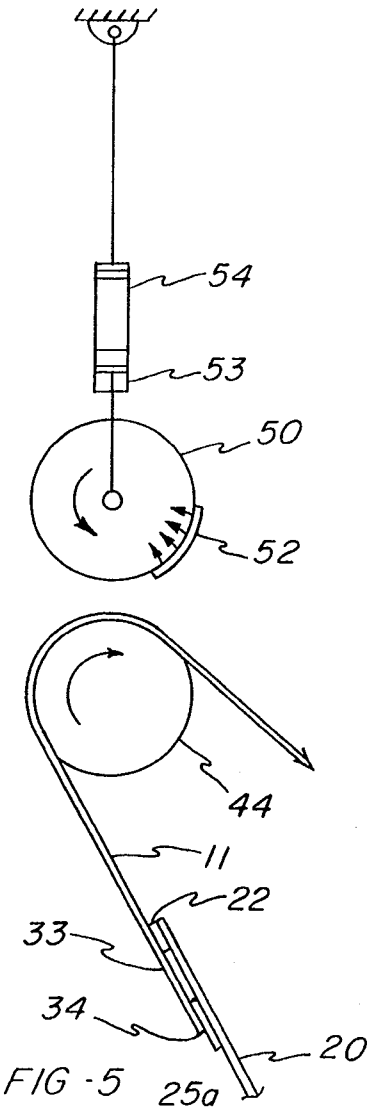

FIG. 5 illustrates the condition when the edge 34 of the tail 33 has been detected by the photocell 36. The cylinder motor 54 has moved the roll 50 to its "ready" position and the roll 50 is accelerated to web speed. In this position the roll 50 is close to but spaced from the roll 44. It is important to note that the rotational position of vacuum roll 50 is controlled by the positioning controller 60 such that the position of the tape 52 is related to the position of the cut end 34 of the tail 33 as the roll 50 is accelerated to web speed.

Figure 6:
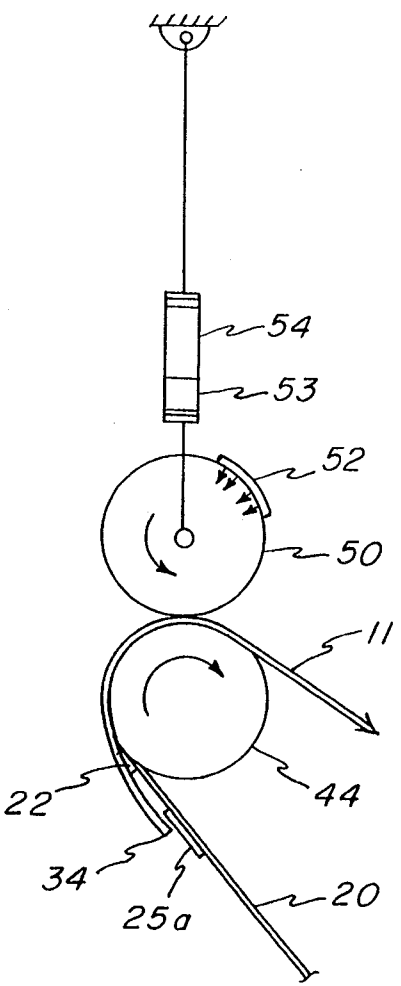

Once the vacuum roll 50 is at web speed and the tape 52 passes through the opening or gap between the rubber covered backing roll 44 and the roll 50, as shown in FIG. 5, the roll 50 is now brought into direct or physical contact with the web 11 on the roll 44, by operation of the cylinder 53, thereby nipping with the progressing web 11. This condition is shown in FIG. 6.

FIGS. 7 and 8 show the condition which exists as the web 11 advances. The leading edge 23 of the fresh web 20 and the splice region 30 including the marker tape 25 pass through the nip. The portion of the web 11 immediately following the splice 30 is flattened by the nipping action between the rolls 44 and 50.

The trailing edge 34 of the tail 33 arrives at the nip just after the tape 52. Since the tape 52 has its adhesive side facing outwardly, the vacuum grip is easily overcome, and the tape 52 now becomes deposited on the outer surface of the tail 33, and across the end 34 of the tall, and against the outer surface of the web 20. In this manner, the tape 52 completely covers the terminal end 34 of the tail and fixes the tail against the surface of the web 20. The tape strip 52 may also completely cover the marker portion 25A, although this is not necessary.

FIG. 9 illustrates the condition of the progressing web downstream toward additional processes. Note that the tape 52 extends at least partially over the tail 33 fully enclosing the end 34, and also onto the exposed surface of the web 20 from the fresh roll 15. This web may now be used in either direction of processing without unduly interrupting the process, since the tail is firmly taped down and cannot fold back over the splice 30 in the event that the direction of web movement is reversed for further processes.

An alternative tail tape application system is described in connection with FIGS. 10 through 13, in which like parts are represented by like reference numerals. In FIG. 10, the progressing web is shown as being supported between a pair of horizontally spaced-apart rolls 80 and 81, and suspended beneath the vacuum roll 50, thereby defining a generally horizontal span section 82. The tail tape 52 and the roll 50 are positioned substantially as previously described in connection with FIG. 4.

In FIG. 11, the end 34 of the tail 33 has been detected as previously described, and the vacuum roll 50 has been positioned by the cylinders 53 and 54 so that the mantel surface of the roll 50 has come in contact with the web 11 at the section 82 between the rolls 80 and 81. In this position, the web 11 wipes across the stationary surface of the roll 50.

As before, the vacuum roll 50 is controlled by its controller 60 and motor 50A, and as the splice 30 with the fresh web 20 and tail 33 approach the vacuum roll 50, the controller 60 operates to accelerate the roll 50, so as to position the tape 52 slightly in advance of the terminal end 34 as the tail 33 passes under the vacuum roll 50.

FIGS. 12 and 13 show that as the tape 52, which has been prepared as previously described, engages the tail 33, it is nearly instantaneously accelerated to web speed, since the vacuum in the vacuum roll 50 isn't too great, and the tape 52 is free to peel away from the vacuum roll 50 and be deposited on the progressing web, even if the vacuum roll 50 is turning at a slower speed. The tape deposition is then completed so that the final result is essentially the same as that previously depicted in connection with FIG. 9.

The concept and method of this invention is not limited to the use of a retro-reflective tape per se, as some other optically detectable marker may be applied to the fresh roll while the roll is being made ready for splicing. Nor is the invention necessarily limited to detector means in the form of a photocell detector.

An alternative arrangement for applying a marker means to the fresh web, to indicate the terminal cut end position 34 of the tail 33, is illustrated in the drawings of FIGS. 14 and 15. In these views, the relative positions of the fresh roll 15 and the expiring roll 12 are reversed for the purpose of showing the turret 10 in its indexed position preparatory to the actual splicing operation. The splicer or paster roll 90 is shown in FIG. 15, as actuated by the cylinder 92, in the act of pressing the progressing web 11 against the fresh roll 15 and causing a splice to be made between the web 11 and the web 20, at a splice region 30 as previously described. A cut-off knife is diagrammatically illustrated at 100, actuated by a cylinder 102, and is fired in accordance with a predetermined program to sever the web 11 from the expiring roll 12 in the known manner.

Attached to the knife 100 is an ink applicator nozzle 110. The nozzle 110 has an exit orifice directed toward the outer surface of the web 11 and is actuated concurrently with actuation of the knife 100.

The ink nozzle 110 may be connected through a flexible tubing 113 to a flow control valve 115 and from the flow control valve to a quantity or source of pressurized marking ink 120. The controllable valve 115 is operated simultaneously with the firing of the knife by the cylinder 102 so that, at the moment the knife blade severs the expiring web, an optically identifiable marker 125 is sprayed or applied to the outer surface of the web 11 immediately forward of the knife 100. The marker 125 may now be detected by the photocell 36 in the manner previously described, as it indicates the position of the cut terminal end 34. Similarly, other marking devices or marking deposition mechanisms may be used, either by placing a mark on the outer wrap of the fresh roll 15 while the roll is being prepared or applied to the expiring web 11 simultaneously with the cutting, as illustrated in FIG. 15. Such marks and sensors need not be optically based. For example, they may be magnetic, nuclear, electrically conductive, etc.

FIG. 16 illustrates a further embodiment in which the tail may be taped down, in appropriate systems, without the necessity of making a detectable mark on either the expiring or fresh webs. The dancer roll 37 is replaced in FIG. 16 with a transducer roll 130. A sensor 132 is placed such that it is operated when the knife 100 severs tile web 11.

The output from the sensor 132 is used, in a like manner as the mark sensor 36 was used in previous descriptions. Thus the controller 60 can predict accurately the actual time in which the terminal end 34 will pass through the nip between the rolls 44 and 50 for the purpose of positioning roll 50 and positioning the tape 52 thereon. This system depends, for its operation, on the maintenance of a finite or predictable length of the progressing web between the cut-off knife 100*a* and the transfer surface of the rubber covered backing roll 44. In this manner, the splice detector 132 can be used with a processor 60 to take the place of the marker means and a marker detector, with either of the taping embodiments shown respectively in FIGS. 8 and 13.

FIG. 17 illustrates a further embodiment of the invention, in which the tape supporting roll 50, which is not necessarily a vacuum roll, is positioned so that it can nip against the fresh roll 15 at the appropriate moment. The progressing web 11 has been positioned by the rotation of the turret on the unwind stand (not shown) so that the web 11 passes through an open nip defined between the tape support roll 50 and the fresh roll 15, as shown in FIG. 17.

In order to make the splice, the fresh roll 15 is first brought up to speed so that the surface speed matches 20 the linear speed of the progressing web, by a combined motor and position sensor 15*a*. A signal from the sensor 15*a* is supplied to the controller 60. At the desired time of splicing, the controller 60 applies a control signal to the motor 50*a*, causing the roll 50 to accelerate to the matched surface speed. At the same time, the controller 60 applies a signal to the position controller 62 which actuates the positioners or the motors 92 and 102 respectively for the roll 50 and the knife 100*a*.

When the tape support roll 50 is at a speed match, with the tape 52 positioned in the correct rotational position so as to cover the cut end 34 of the tail, the actuator 92 closes the nip immediately after the tape has passed through the open nip. The general position is as shown in FIG. 17, and the moved position of the roll 50 is shown in FIG. 18.

The web cut-off knife 100*a*, actuated by the positioner or motor 102, shears the progressing web 11 against an anvil 103, creating the tail 33 as shown in FIG. 18. The tail 33 overlaps the web 20 on the roll 15 so that the splice tape 22 bonds the fresh web 20 to the progressing web 11 thereby forming a splice with a short tail. The position of the tape 52 on the roll 50 is timed so that coincides with the passage of the end 34 through the nip. This condition is shown in the enlarged diagram of FIG. 19.

The tape 52 is then deposited on the tail 33 and over the end 34, as both pass through the nip which is created by the tape support 50 and the fresh roll 15. The spliced webs and the taped down tail, after taping and pressing by the rolls, will appear substantially as shown in FIG. 9.

A further embodiment, when a finite or predictable length of the progressing web 11 between the cut-off knife 100*a* and the transfer surface of the rubber covered backing roll 44 is maintained, is to detect or predict the terminal end 34 by means of a web splicing system such as described in the previously identified U.S. Pat. No. 3,253,795. The detection or prediction signal from this system is used to take the place of the splice detector 132 and can be used with a processor 60 with either of the taping embodiments shown respectively in FIGS. 8 and 13.

While the methods herein described, and the forms of apparatus for carrying these methods into effect constitute preferred embodiments of this invention, it is to be understood that the invention is not limited to these precise methods and forms of apparatus, and that changes may be made in either without departing from the scope of the invention, which is defined in the appended claims.

What is claimed is:

1. In the art of web unwinding in which a fresh web is spliced onto a moving expiring web, and in which a trailing tail of a cut expiring web laps a portion of the fresh web, the method of taping such tail to the fresh web without interrupting the movement of such web, comprising the steps of:

a) placing a detectable marker on at least one of said webs in a fixed relation to the end of said tail, b) placing a strip of adhesive tape on the surface of a tape applicator roll and driving such roll with a surface speed equal to the speed of the fresh web, c) detecting said marker and providing an electrical signal representing the position of the end of the tail, and d) moving said applicator roll in response to said electric signal to bring said strip of adhesive tape to said tail for taping down said tail end to said fresh web.

2. The method of claim 4 further comprising the steps of supporting said strip of adhesive tape on the surface of a tape support roll prior to said determining step, and in which said applying step includes moving said tape support roll with said strip of tape applied thereto relative to said fresh web such that said tape engages said tail at said end thereof in the region of said marker.

3. The method of claim 2 in which said tape support roll is a vacuum roll.

4. In the art of web unwinding in which a fresh web is spliced at a splicing station onto a moving expiring web and in which a cut trailing tail of the expiring web, after splicing, laps a portion of the fresh web, the method of taping such tail to the fresh web without interrupting the movement of the fresh web, comprising the steps of:

a) placing an optically detectable marker on at least one of said webs in a predetermined position relative to the end of said tail, b) optically detecting said marker at a position downstream from said splicing station, c) supporting a strip of adhesive tape on the surface of a vacuum roll, and d) moving said vacuum roll in with said adhesive tape strip applied relative to the movement of said fresh web in response to said detection of said marker and causing said tape to engage said tail in relation to the position of said detected marker for taping said tail down onto said fresh web.

5. The method of claim 4 in which said optically detectable marker is in the form of a strip of reflective tape applied to said fresh web prior to splicing with said expiring web so that a portion thereof extends along said fresh web from under the tail.

6. The method of claim 4 in which said placing step comprises the placing of said marker on said tail simultaneously with the severing of said tail from said expiring web.

7. Apparatus for taping down the tail of a splice on a progressing web in which a leading edge of the web from a fresh roll is spliced onto an expiring web thereby forming an overlapping splice, and in which a knife severs the expiring web following the splice and forms a trailing tail of the expiring web, which tail extends upstream from the splice in overlapping relation to the fresh web, comprising:

means on at least one of said webs indicating the position of the cut end of said tail along the progressing web, means responsive to said indicating means for applying a piece of hold-down tape over said tail cut end and onto the adjacent portion of said fresh web without interrupting the progressing movement of said webs.

8. The apparatus of claim 7 in which said indicating means comprises a length of reflector tape on said fresh web in which following splicing an exposed portion of said tape extends from a position under said tail upstream along said fresh web and in which said means responsive to said indicator means includes a photodetector positioned along a path of movement of said progressing web to detect the passing thereby of said exposed tape portion.

9. The apparatus of claim 7 further comprising means associated with said knife for placing said indicator means in the form of an optical marker on said tail adjacent the cut end thereof concurrently with the cutting of said expiring web by said knife.

10. The apparatus of claim 7 in which said indicating means is an electrical signal.

11. The apparatus of claim 10 in which said electric signal is formed concurrently with the severing by said knife of said expiring web.

12. In the art of web unwinding in which a fresh web is spliced onto a moving expiring web, and in which a trailing tail of a cut expiring web laps a portion of the fresh web, the method of taping such tail to the fresh web without interrupting the movement of such web, comprising the steps of:

a) placing a marker on at least one of said webs at the end of said tail including the step of placing a strip of reflective tape on said fresh web so that following splicing of said webs an exposed portion of said strip extends along said fresh web from beneath the cut end of said tail thereby forming a marker, b) detecting said marker to determine the position of the end of the tail, and c) applying a strip of adhesive tape to said tail at said determined position for taping down said tail end to said fresh web.

13. In the art of web unwinding in which a fresh web is spliced onto a moving expiring web, and in which a trailing tail of a cut expiring web laps a portion of the fresh web, the method of taping such tail to the fresh web without interrupting the movement of such web, comprising the steps of:

a) placing a marker on at least one of said webs at the end of said tail including the step of making a mark on the expiring web concurrently with the severing of the expiring web following the splicing of the fresh web thereto, thereby forming a marker on the expiring web, b) detecting said marker to determine the position of the end of the tail, and c) applying a strip of adhesive tape to said tail at said determined position for taping down said tail end to said fresh web.

* * * * *